United States Patent [19]

Holmsten et al.

[11] Patent Number: 4,905,970

[45] Date of Patent: Mar. 6, 1990

[54] DASHER BOARD SYSTEM FOR ATHLETIC PLAYING SURFACES

[75] Inventors: Charles W. Holmsten, St. Paul; Robert G. Vohnoutka, Eden Prairie; Jay McDougall, Fergus Falls, all of Minn.

[73] Assignee: Holmsten Ice Rinks, Inc., St. Paul, Minn.

[21] Appl. No.: 327,974

[22] Filed: Mar. 23, 1989

[51] Int. Cl.[4] ..... E04H 17/16

[52] U.S. Cl. ..... 256/24; 256/73; 272/3

[58] Field of Search ..... 256/24, 31, 73; 272/3; 62/235

[56] References Cited

U.S. PATENT DOCUMENTS

| | | | |
|---|---|---|---|
| 3,727,888 | 4/1973 | Nickolas | 256/24 |
| 3,844,539 | 10/1974 | Abbott | 256/24 |
| 3,883,120 | 5/1975 | Tippmann | 256/24 |
| 4,271,622 | 6/1981 | Tippmann | 256/24 X |

*Primary Examiner*—Andrew V. Kundrat
*Attorney, Agent, or Firm*—Haugen and Nikolai

[57] ABSTRACT

A dasher board system for athletic playing surfaces includes interconnected, substantially identical dasher board sections. One embodiment employs a polyethylene facing panel backed by a plywood panel, with both supported by upright tubing sections anchored to perimeter concrete. Horizontal channel members above the panels and vertical channel members at panel edges and intermediately of the panels support transparent shielding for spectator viewing and protection. An alternative embodiment dasher board section includes a transparent facing panel secured by a framework of battens. Yet another alternative embodiment employs a unitary fiberglass lower panel with a facing section and rim including top, bottom and side flanges. Further, a triangular shielding panel and attendant support structure are disclosed for use between dasher sections with shielding and dasher sections without shielding.

18 Claims, 7 Drawing Sheets

DASHER BOARD SYSTEM FOR ATHLETIC PLAYING SURFACES

BACKGROUND OF THE INVENTION

This invention relates to wall enclosures around athletic playing surfaces, and more particularly to a system of interconnected dasher board panels suitable for ice hockey rinks, skating rinks and for soccer fields.

Over the years, a common practice in the construction of skating rinks has been to utilize wooden vertical supports or posts, horizontal, spaced apart wooden frame members between the posts, all usually constructed of 2"×4", 2"×6" or other dimensioned lumber, and plywood panels fastened to the uprights and horizontal frame members by nails, screws or the like. This approach is costly as it requires construction of the dasher board system on site. Moreover, the plywood panels are subject to damage due to moisture and temperature extremes in the case of outdoor rinks, and from the physical contact with skate blades and the like typically occurring in hockey games.

In view of these deficiencies, alternative dasher board structures have been proposed. For example, U.S. Pat. No. 3,883,120 (Tippmann) discloses a dasher board system in which the dasher boards are one-piece fiberglass panels, having a smooth front face with an integrally formed border extended at about 90° from the face, and a plurality of bolsters or vertical bent portions for providing stability. The upright end edges of the fiberglass panels are fashioned as tongue and grooves, to facilitate joinder and alignment of adjacent panels.

The rising popularity of soccer, particularly indoors, has created a need for dasher board systems suitable for surrounding soccer playing fields. Such a system advantageously would be interchangeable with hockey and ice rink dasher board systems, to permit use of the same indoor facility for these events, and at minimal changeover cost. It is desirable for soccer dasher boards to provide maximum visibility.

Therefore, it is an object of the present invention to provide a modular dasher board system comprised of separately constructed, interconnected panels.

Another object of the invention is to provide an improved means for supporting the transparent upper shielding portion of the dasher board system, and further in the case of soccer to provide for transparent dasher panel bottom sections in order to enhance spectator viewing.

Another object is to provide a system of dasher panels, for soccer and for hockey, suitable for low cost and convenient installation.

Yet another object is to provide a means for supporting an upper transparent shielding panel of the dasher section in a manner which also facilitates alignment of adjacent panels.

SUMMARY OF THE INVENTION

To achieve these and other objects, there is provided an assembly of interconnected dasher boards for surrounding an athletic playing surface. Each board comprises a lower front facing panel, and can include a reinforcing lower panel at least approximately the same size as the facing panel and contiguous with it. A plurality of spaced apart horizontal frame members are attached to the reinforcing panel along the surface opposite to that contiguous with the facing panel. A plurality of first upright spaced apart edge supporting frame assemblies are positioned at each junction of adjacent dasher boards. Each upright frame assembly is anchored with respect to the playing surface, at a point outside of the perimeter of the playing surface. A plurality of intermediate upright frame assemblies are positioned between the upright edge frame assemblies. A plurality of brackets, integral with the intermediate upright support assemblies, are removably mounted to the horizontal frame members to secure the frame members integrally with respect to the intermediate upright frame assemblies.

Preferably, the upright support frame assemblies include upper and lower rectangular tubing sections. A support pocket is formed integrally with the top portion of the lower section, while the upper section includes a narrower bottom portion sized for nesting engagement within the pocket of its associated lower tubing section, thereby to form an integral assembly of the upper and lower tubing sections. The lower section can correspond in height to the lower panel, which facilitates installation in that the lower portion of the dasher board system can be installed first, with upper transparent shielding panels installed after the upper tubing sections have been installed in drop-in fashion.

For directly supporting transparent acrylic panels in the upper section of the dasher board system, upwardly open U-shaped aluminum channel members are mounted along the top of the lower panel sections, and further channel members, H-shaped in crosssection, are vertically mounted with respect to the tubing sections. Preferably a flexible or compressible liner is installed into the U-shaped and H-shaped channels, to more firmly secure the shielding panels and protect them against damage. The U-shaped channels, in cooperation with the upright channels at panel junctions, assist in the alignment of adjacent dasher panel sections.

In one modification particularly suited for soccer, the dasher board lower panel is constructed of a transparent panel, surrounded by a frame formed of battens, also preferably of plastic. The panel and battens are routed at their interfacing edges to provide for secure mounting of the panel and yet maintain flush panel and batten edges.

In another form of the invention, the lower panel sections are one-piece fiberglass, consisting of a facing section and a border of upper, lower and side flanges generally perpendicular to the facing. The upright side flanges are formed in part as U-shaped channels and are adapted to surround upright support members between adjacent panels.

Yet another feature of the invention is an intermediate panel between a dasher board section provided with an upper transparent shielding panel and an adjacent section without shielding. Upright, horizontal and intermediate interconnected channel members support a right triangular, transparent panel above the end portion of the dasher panel next to the end dasher panel having the transparent panel above it.

A dasher board system constructed in accordance with the present invention are less expensive to install, since individual dasher panels can be pre-assembled for interconnection on site. Dasher panels suited to ice sports and soccer can be provided for interchangeable mounting to increase flexibility of a particular indoor facility. If desired, transparent bottom panel sections can be provided for use with soccer for better viewing. Moreover, the channel members provided for supporting upper transparent acrylic panels also cooperate with one another to align adjacent dasher panels and further strengthen the system.

IN THE DRAWINGS

For a better understanding of the above and other features and advantages, reference is made to the following detailed description of the preferred embodiment and drawings, in which:

FIG. 1 an elevation of part of a dasher board system for surrounding an athletic playing surface, as viewed from the playing surface;

DETAILED DESCRIPTION OF THE PREFERRED EMBODIMENTS

Figure 1:
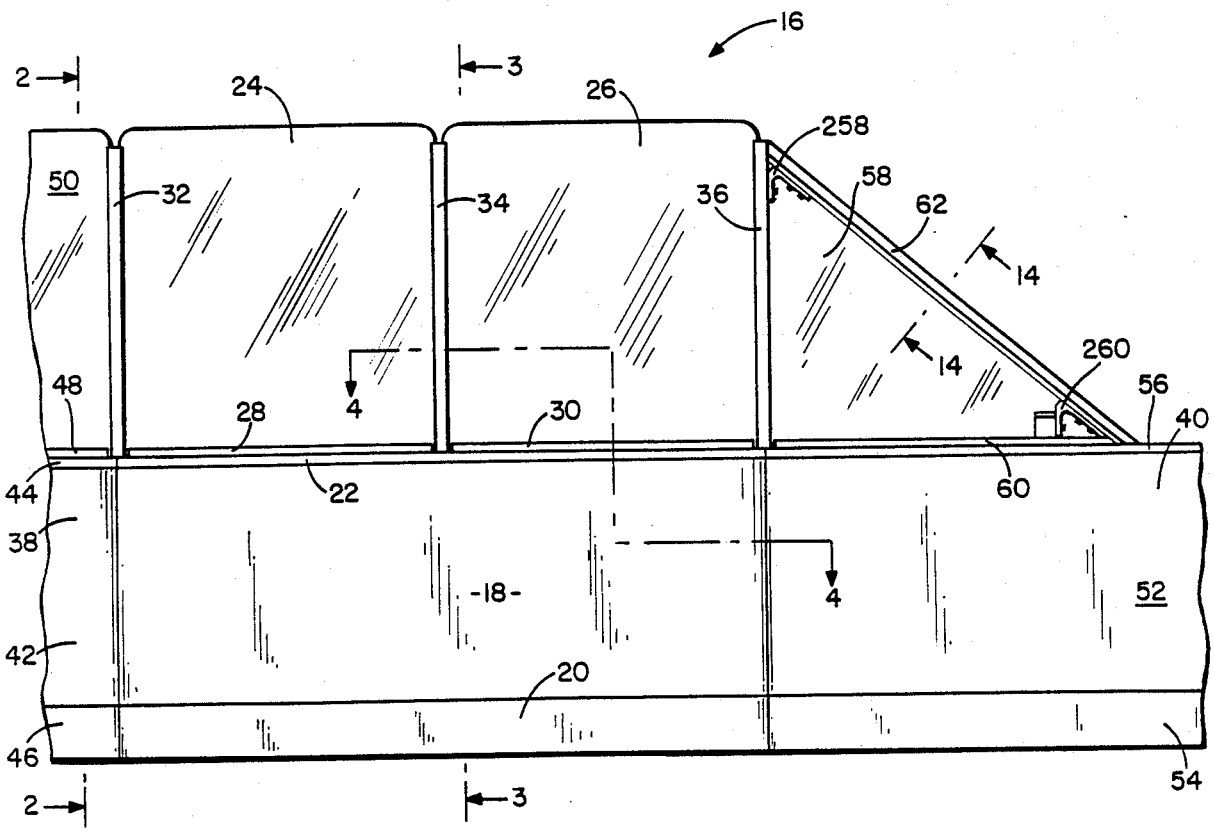

Turning now to the drawings, there is shown in FIG. 1 a dasher board section 16 which is part of a system of interconnected dasher board sections suitable for surrounding a hockey rink, soccer field or other athletic playing surface. The system defines the perimeter of the surface and is generally rectangular, but with curved segments in lieu of sharp corners. Curved dasher board sections forming such rounded portions are known and not particularly germane to the present invention, and therefore are not further discussed.

Dasher board section 16 includes a rectangular facing panel 18 forming the bottom portion of the dasher board section, and preferably constructed of polyethylene. A kick-plate 20, also of polyethylene, forms a continuous strip covering the bottom edge portion of the facing panel. At the top of panel 18 is a cap rail 22 constructed of polyethylene. The facing panel, cap rail and kick-plate can be of different colors, e.g. selected in accordance with the colors of a particular team.

Forming the upper portion of dasher board section 16 are first and second transparent shielding panels 24 and 26, constructed of an acrylic or tempered glass. The shielding panels provide spectator viewing and protection. For supporting shielding panels 24 and 26, first and second horizontal shield supports or channel members 28 and 30 are fastened to the cap rail and capture the bottom edges of the shielding panels. Side edge support for the panels is provided by upright shield supports or channel members 32, 34 and 36, each containing a portion of the upright side edges of its associated panels Connected to dasher board section 16 on opposite sides are adjacent dasher board sections 38 and 40. A facing panel 42, cap rail 44 and kick-plate 46 of section 38 are substantially flush with and aligned with their counterparts of dasher board section 16. A horizontal channel member 48, in cooperation with upright shielding support 32, support a shielding panel 50.

Likewise, dasher section 40 has a facing panel 52, kick-plate 54 and a cap rail 56. However, in lieu of a rectangular shielding panel, a triangular glance panel 58 is provided and surrounded by upright support 36, a horizontal channel member 60 and an inclined rail 62.

Figure 2:
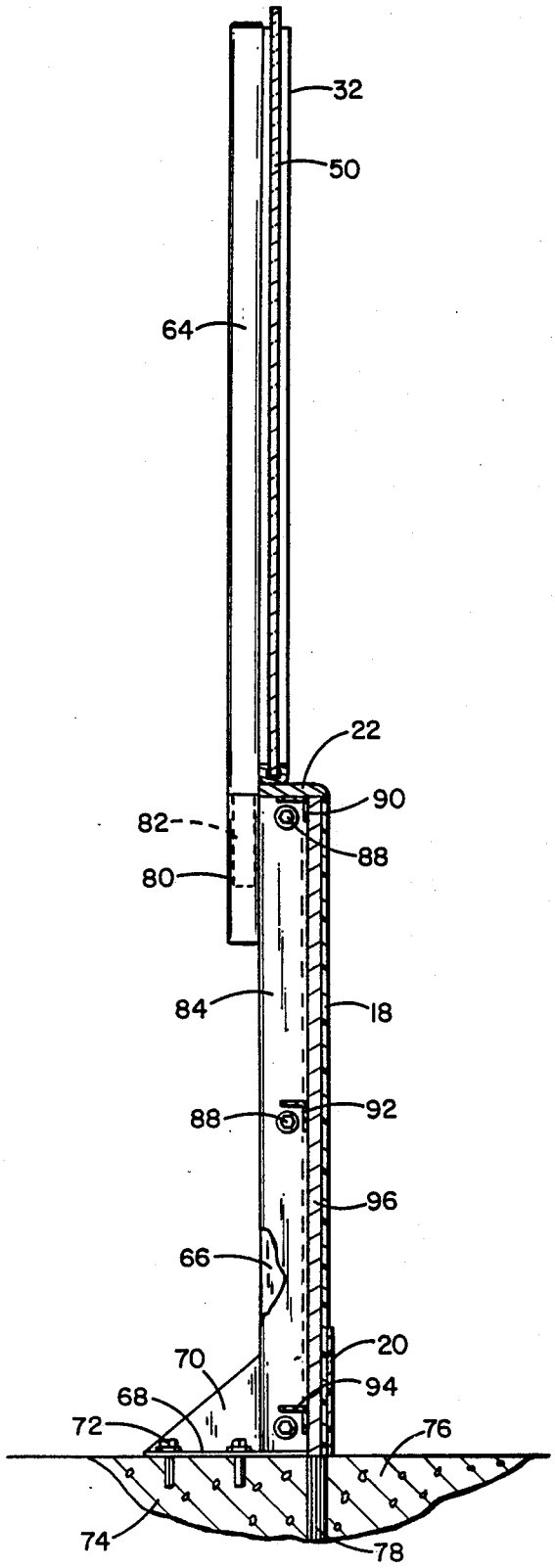
FIG. 2 is a sectional view taken along the line 2—2 in FIG. 1.

Structural support for the dasher board system is provided by a series of upright frame assemblies at the junctions of adjacent dasher sections and intermediately along dasher sections. A junction frame assembly, as seen in FIG. 2, includes upper and lower tubing sections 64 and 66 of 2"×2" and 2"×3" steel, respectively. A base plate 68 and stabilizing gusset 70 are attached integrally to the bottom of tubing section 66, for example by welding. Anchoring bolts 72 secure base plate 68 to perimeter concrete 74 to secure the lower tubing section. In this manner, the dasher board system is secured to the perimeter concrete rather than refrigerated concrete 76 directly beneath the ice. An expansion joint 78 separates the perimeter and refrigerated concrete. Consequently, virtually the entire dasher board system is positioned beyond the refrigerated concrete, minimizing build-up of ice at the base of the dasher board system and attendant problems. A pocket 80 of 2"×2" steel tubing is integrally attached to the top portion of tubing section 66.

Over a majority of its length, upper tubing section 64 is 2"×2" steel tubing. Its bottom portion 82 is $1\frac{3}{4}$"×$1\frac{3}{4}$" tubing which forms a tight, nesting engagement within pocket 80 when the upper tubing section is inserted into the pocket from above.

Figure 4:
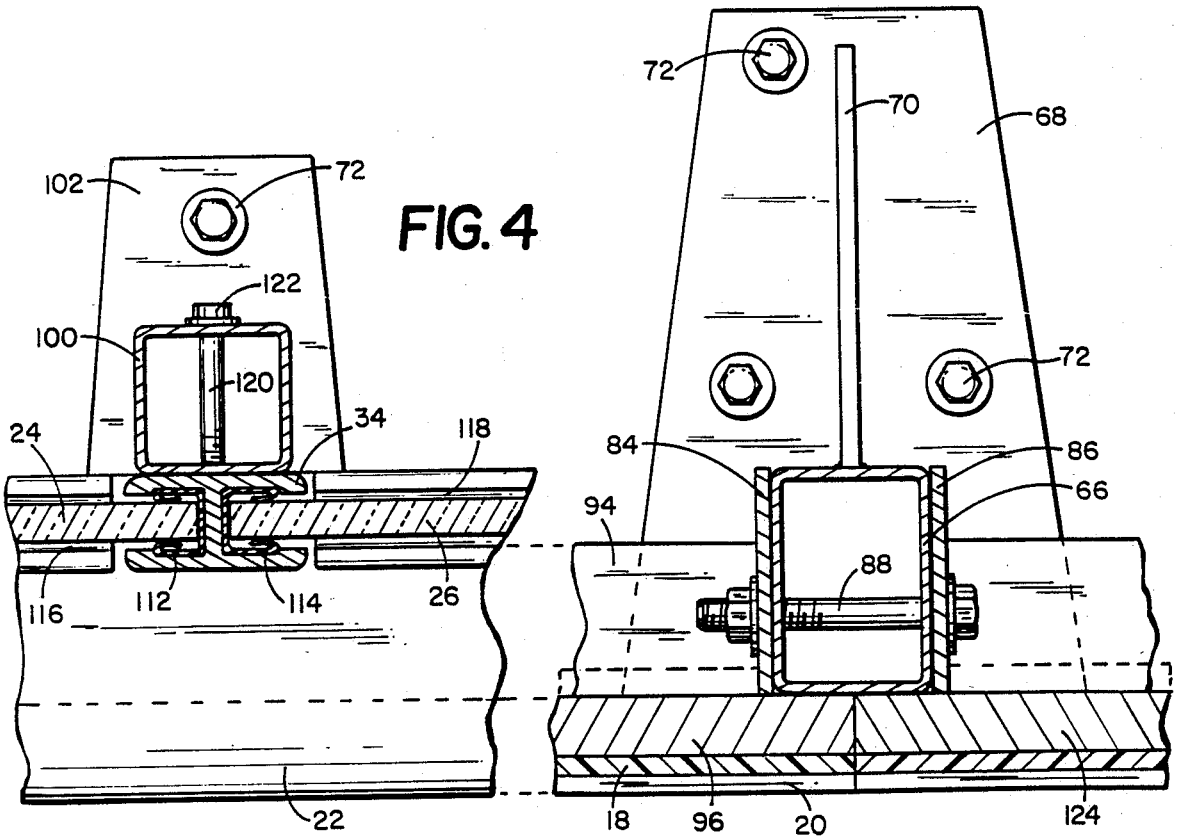
FIG. 4 is a sectional view taken along the line 4—4 in FIG. 1.

A pair of steel end plates 84 and 86 (FIG. 4) are mounted to opposite sides of lower tubing section 66, secured to the tubing by nut and bolt assemblies 88. Three horizontal frame members 90, 92 and 94 of angle steel or steel tubing are attached to end plate 84 and extend along their associated dasher section to an end plate at the next dasher panel junction, and are fixed to that end plate as well. Frame members 90, 92 and 94 are attached to and support a backing panel 96, preferably of exterior grade plywood. Alternatively, facing panel 18 is formed to have a greater thickness and directly supports the frame members in lieu of any plywood. Backing panel 96 is sized to match facing panel 18 and provides the required support for the facing panel. The facing panel is secured to the backing panel by countersunk flathead screws or in a similar manner to avoid any protruding fasteners.

Figure 3:
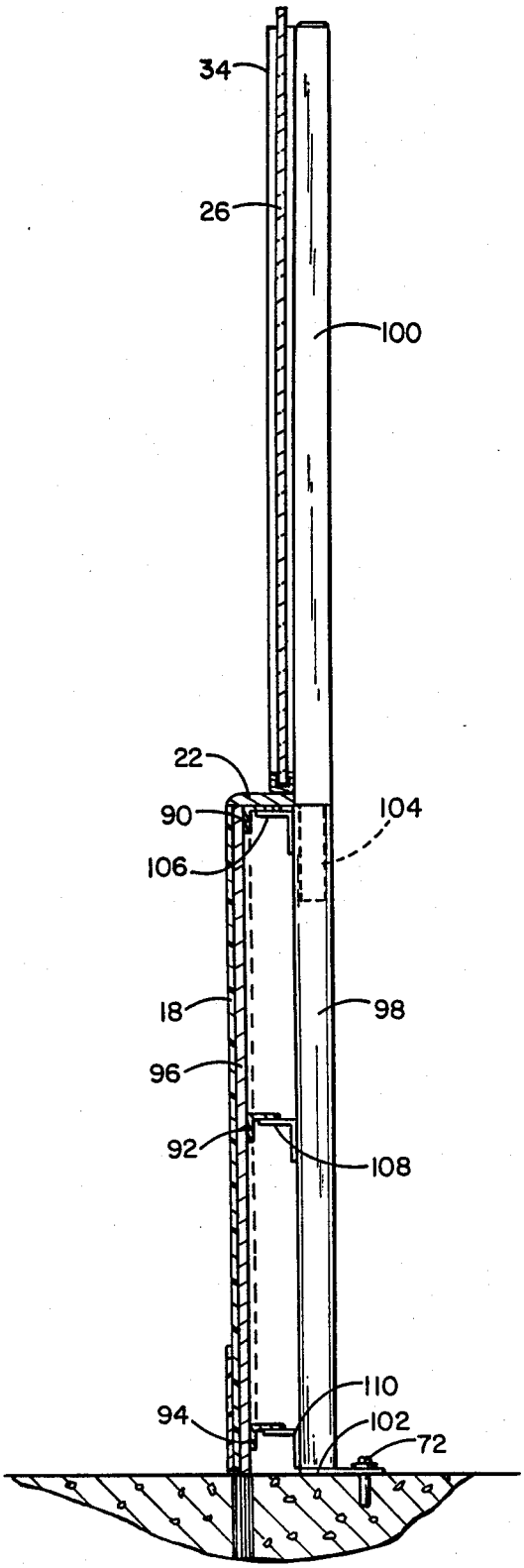
FIG. 3 is a sectional view taken along the line 3—3 in FIG. 1.

An intermediate frame assembly is shown in FIG. 3, and includes a lower tubing section 98 and an upper tubing section 100, both 2"×2". The lower steel tubing section is anchored to perimeter concrete 74 by an anchoring bolt 72 through a base plate 102 integral with the tubing. The top portion of tubing 98 provides a pocket to receive a narrowed portion 104 of upper tubing section 100, nestingly in the manner described in connection with the edge frame assemblies. A plurality of steel clips are fastened integrally to lower tubing section 98 as shown at 106, 108 and 110, each at a height selected for fastening to its associated one of frame members 90, 92 and 94. With the clip and frame members fastened, intermediate lower tubing sections 98 cooperate with edge lower tubing sections 66 to support the face and backing panels.

As seen in FIGS. 2 and 3, each of the horizontal shield supports or channel members is U-shaped in cross-section to capture the bottom portion of its associated shielding panel. Similarly, the upright panel supports are H-shaped in cross-section as seen from FIG. 4 in connection with upright support 34, so that each upright support captures the upright side edges of its associated pair of shielding panels.

The horizontal and vertical shielding supports thus provide channels which receive the bottom and side edges of each shielding panel. For a tighter fit and to protect the shielding edges, U-shaped cushion inserts 112 and 114 are provided in the opposed channels of upright support 34. Similar cushion inserts 112 and 114 are provided in horizontal shield supports 28 and 30, respectively. The inserts preferably are a flexible material that bends elastically when shielding is installed. One suitable material is ABS plastic. Alternatively, compressible material can be employed. The remaining shielding supports are provided with similar inserts. As is best understood from FIG. 1, each shielding panel is installed simply by positioning it between an adjacent pair of upright panel supports and pushing it downwardly until its bottom edge nests within its associated horizontal shielding support. The cushion inserts within the channels firmly hold the shielding panel, and no auxiliary fastening structure is required.

Proper alignment of the upright panel supports results from their attachment to their associated end and intermediate upper tubing sections. For example, a barrel screw 120 with an allen head cap 122 secures upright shielding support 34 to intermediate upper tubing section 100. The other upright shielding supports are similarly secured. As seen from FIG. 4, steel end plates 84 and 86 are fastened against lower end tubing section 66 in a manner to achieve a flush alignment of adjacent facing panels 18 and 52, kick-plates 20 and 54 and backing panels 96 and 124.

Figure 5:
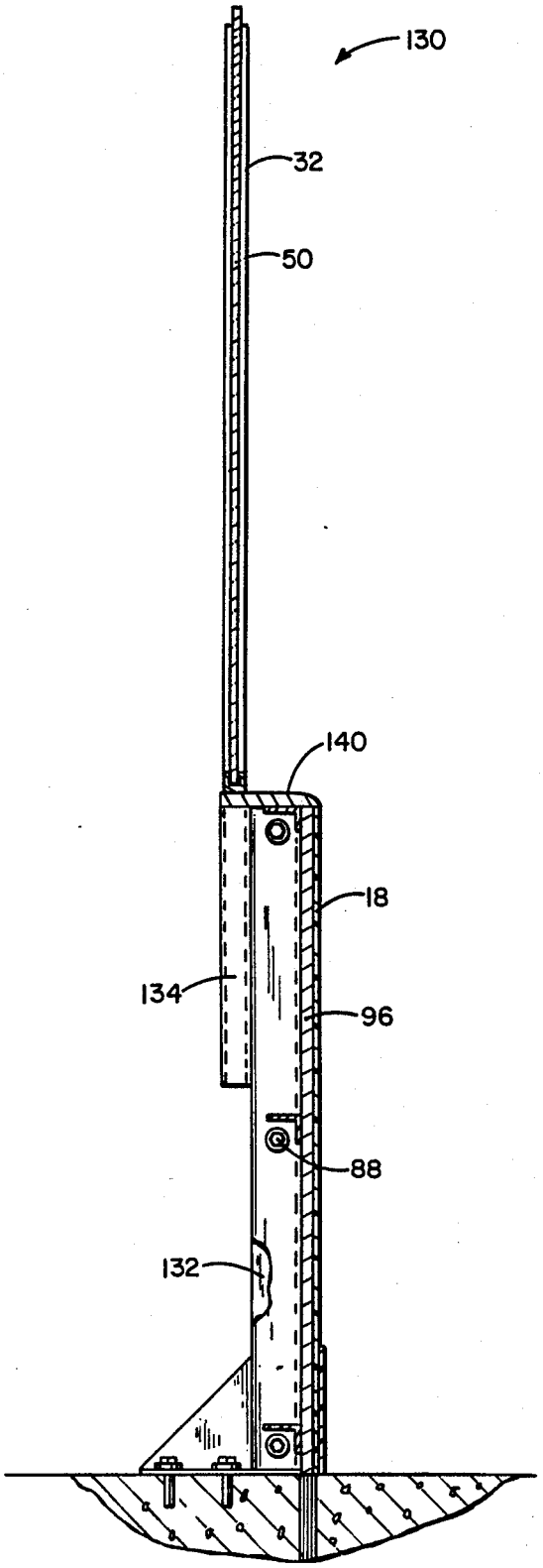
FIG. 5 is a sectional view similar to that of FIG. 2 but illustrating an alternative embodiment dasher panel.
Figure 6:
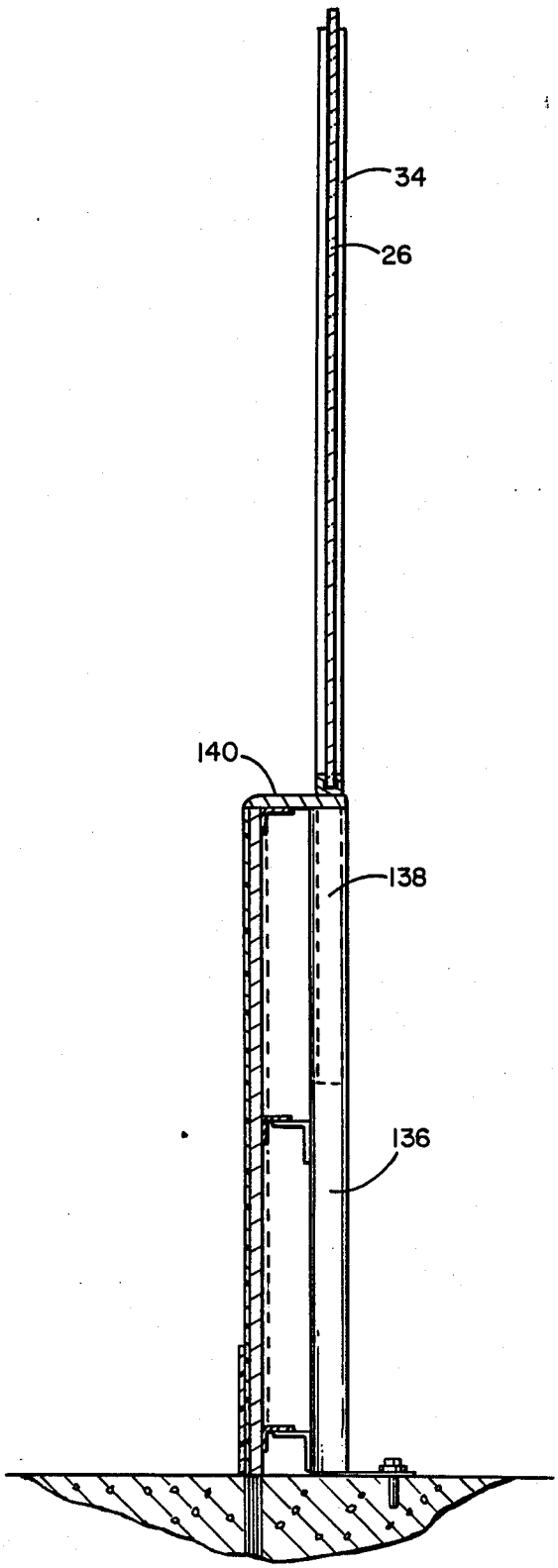
FIG. 6 is a view similar to that of FIG. 3 illustrating the second embodiment dasher panel.
Figure 7:
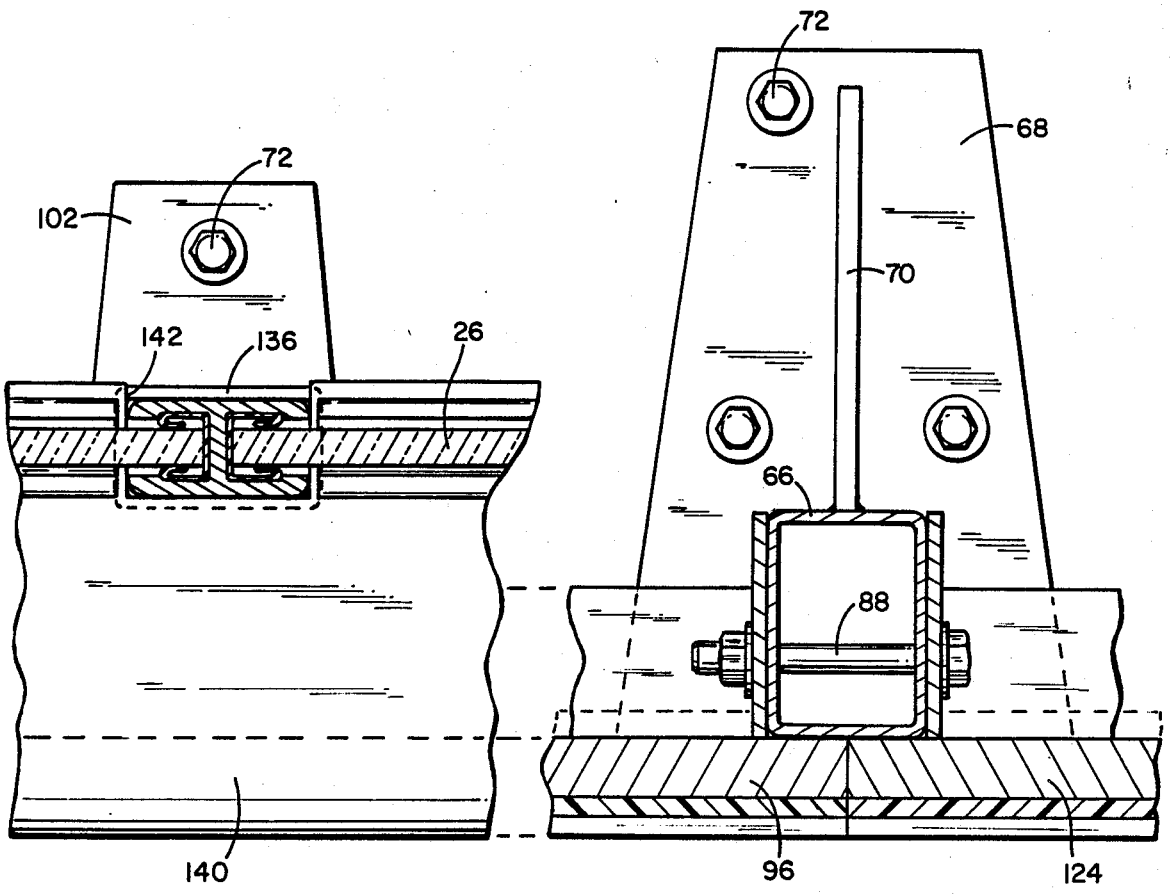
FIG. 7 is a view similar to that in FIG. 4 showing the second embodiment dasher panel.

FIGS. 5–7 illustrate an alternative embodiment dasher board section 130 in which the lower tubing sections support the upright shield supports or channel members in drop-in fashion, eliminating the need for the upper edge and intermediate tubing sections. In particular, an alternative edge tubing section 132 includes an integrally formed pocket 134 for directly receiving upright shield support 34. Likewise, an alternative intermediate tubing section 136 includes an upper portion which provides a pocket 138 for upright shielding support 36. A cap rail 140 of the alternative embodiment dasher panel is wider than first embodiment cap rail 22, and is provided with notches, one of which is indicated at 142 in FIG. 7, and similar notches at the dasher section edges, in order to accommodate the upright shielding supports.

FIGS. 8–11 show a third embodiment dasher section 146 particularly well suited for soccer, in that a facing panel 148 of the section is constructed of a transparent acrylic to afford better spectator viewing, a construction possible in connection with soccer or other sports which involve less physical contact with facing panels a compared with ice hockey. Facing panel 148 is surrounded with a framework including a top batten 150, a bottom batten 152, and first and second upright edge battens 154 and 156 Above the top batten is a cap rail 158 which supports horizontal channel members 28 and 30 as previously described. The horizontal channel members cooperate with upright channel members 32, 34 and 36 to support acrylic shielding panels 24 and 26. A series of flathead, countersunk screws 160 hold the battens in place.

Figure 9:
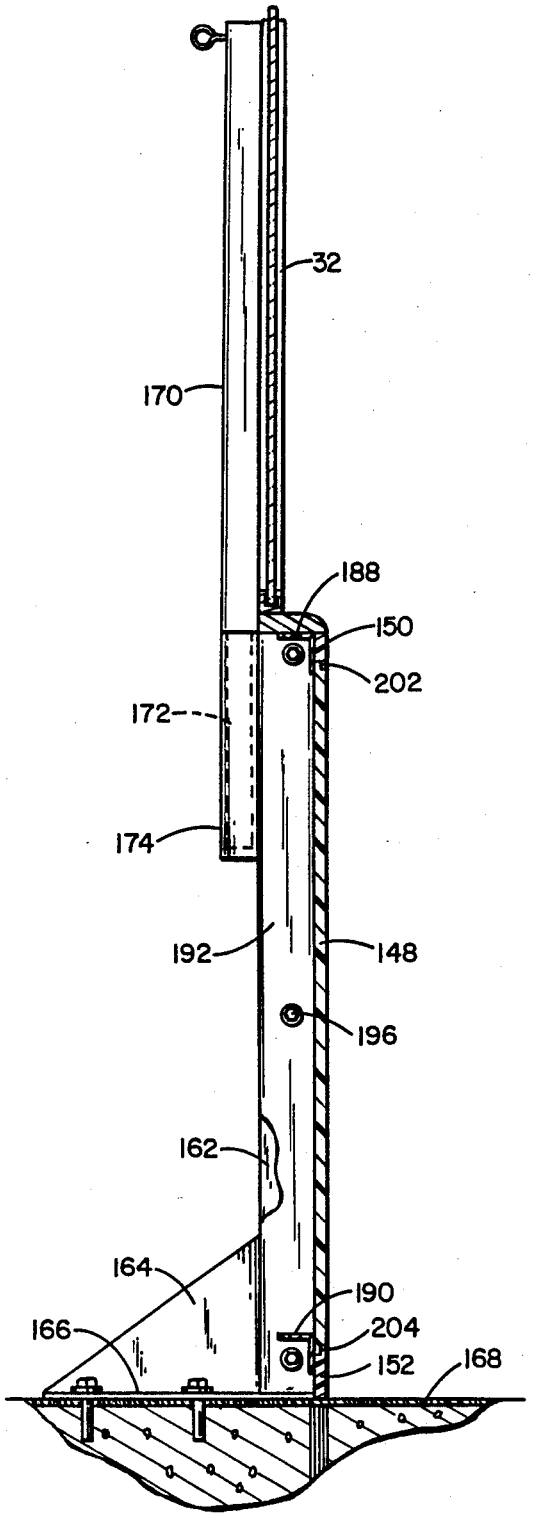
FIG. 9 is a sectional view similar to that in FIG. 2 but showing the third embodiment dasher panel.
Figure 10:
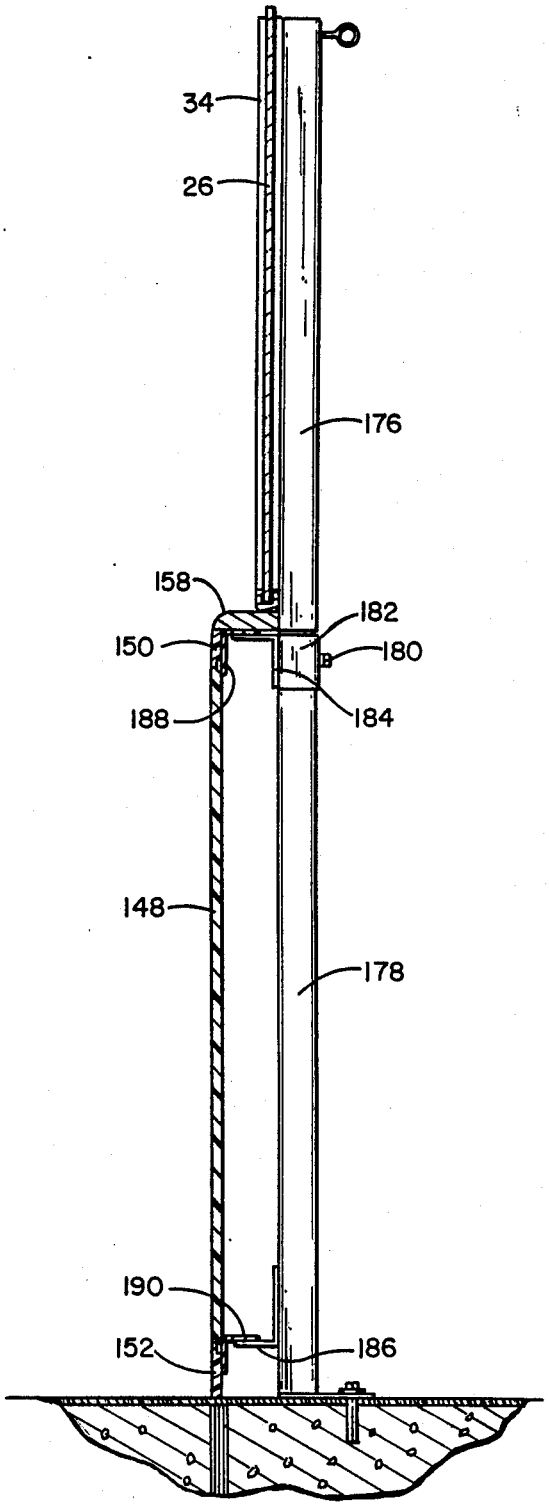
FIG 10 is a sectional view similar to that in FIG. 3 but showing the third embodiment dasher panel.

As seen in FIGS. 9 and 10, dasher sections 146 are supported by end and intermediate upright assemblies much as described in connection with first embodiment dasher section 16. Support at dasher section junctions is provided by a lower tubing section 162 with a gusset 164 and base plate 166 anchored into the concrete through the base plate and a playing surface overlay 168. An upper tubing section 170 has a reduced bottom portion 172 received in a pocket 174 formed in the lower tubing section.

An intermediate upper tubing section 176 has a reduced size bottom portion received in a lower tubing section 178, and is secured by a bolt 180 through a sleeve 182. Upper and lower angled clips 184 and 186 are secured to lower tubing section 178 and sleeve 182 respectively, and support upper and lower angle frame members 188 and 190 running the length of the upper and lower battens.

Figure 11:
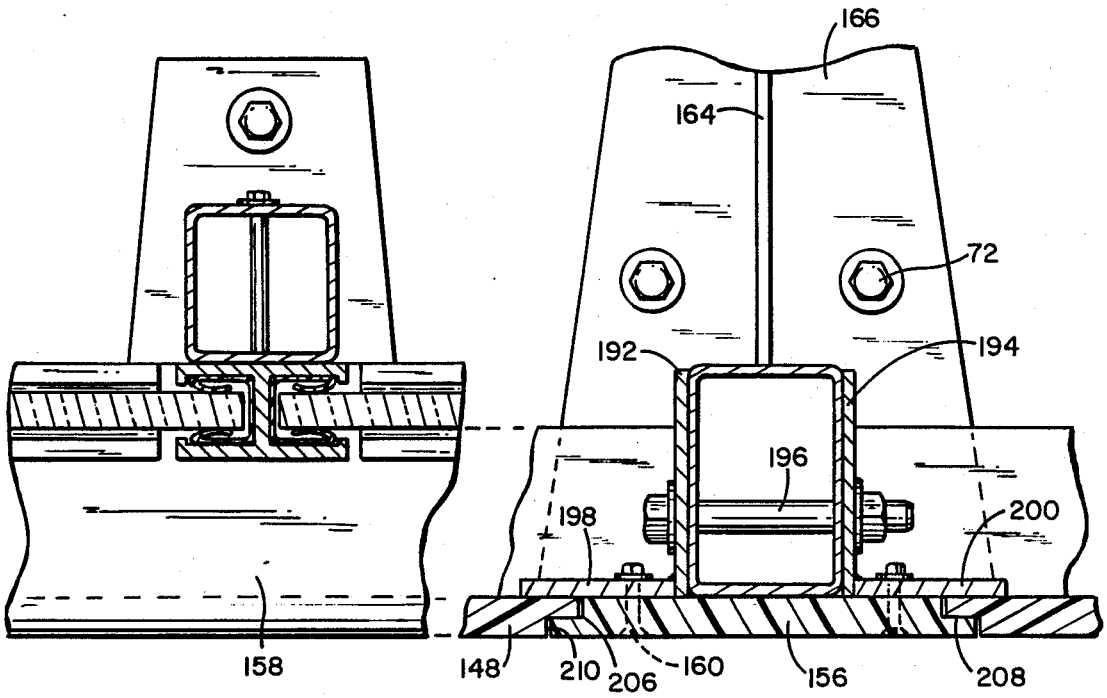
FIG. 11 is a sectional view similar to that in FIG. 4 but showing the third embodiment dasher panel.

Screws 160 secure top and bottom battens 150 and 152 to angled frame members 188 and 190, respectively, thus to secure the battens with respect to the intermediate upright assemblies. The upright battens are secured as shown in FIG. 11 in connection with batten 156. In particular, steel end plates 192 and 194, secured to tubing section 162 by nut and bolt assemblies 196, have integrally fastened right angle portions at 198 and 200, respectively, which directly support batten 156 and the end portions of the adjacent top and bottom battens.

As seen in FIGS. 9 and 10, right angle inside cutouts 202 and 204 respectively run the length of top and bottom battens 150 and 152. Similar cutouts are made on both sides of each upright batten, as indicated at 206 and 208 in FIG. 11. In turn, facing panel 148 is provided with outside, right angle cutouts 210 along its top, bottom and side edges. As a result, the framework formed by the battens secures the facing panel by rabbet joints between the facing panel edges and battens. As indicated in FIG. 11, it is desirable to leave a slight gap between facing panel 148 and its adjacent battens to allow for thermal expansion and contraction The rabbeted mounting ensures a flush alignment of the panels and battens to present a smooth continuous surface facing the soccer playing field.

Figure 15:
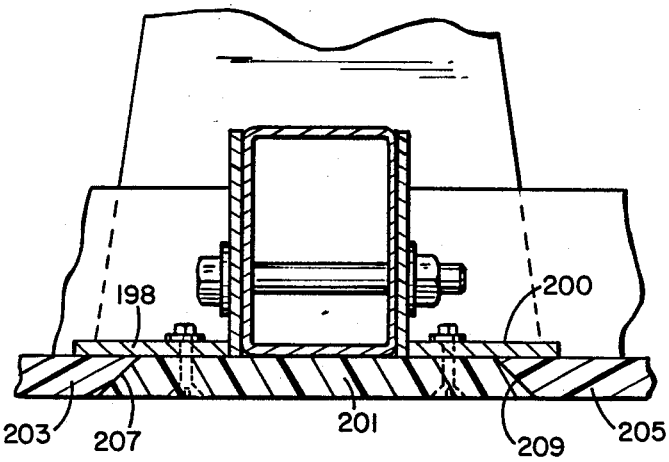
FIG. 15 is a view similar to a portion of FIG. 11 showing an alternative batten structure for the third embodiment dasher panel.

FIG. 15 shows an alternative version of the third embodiment dasher board system, in which mitered joints secure the panels. In particular, an upright edge batten 201, supported in the same manner with respect to upright tubing 66 by upright portions 198 and 200, secures two adjacent facing panels 203 and 205. Mitered joints, as indicated at 207 and 209, are formed between edge batten 201 and its adjacent panels by virtue of their correspondingly inclined vertical edges. Facing panels 203 and 205, and associated top and bottom battens (not shown) are likewise provided with correspondingly inclined edges to form mitered junctions.

Figure 12:
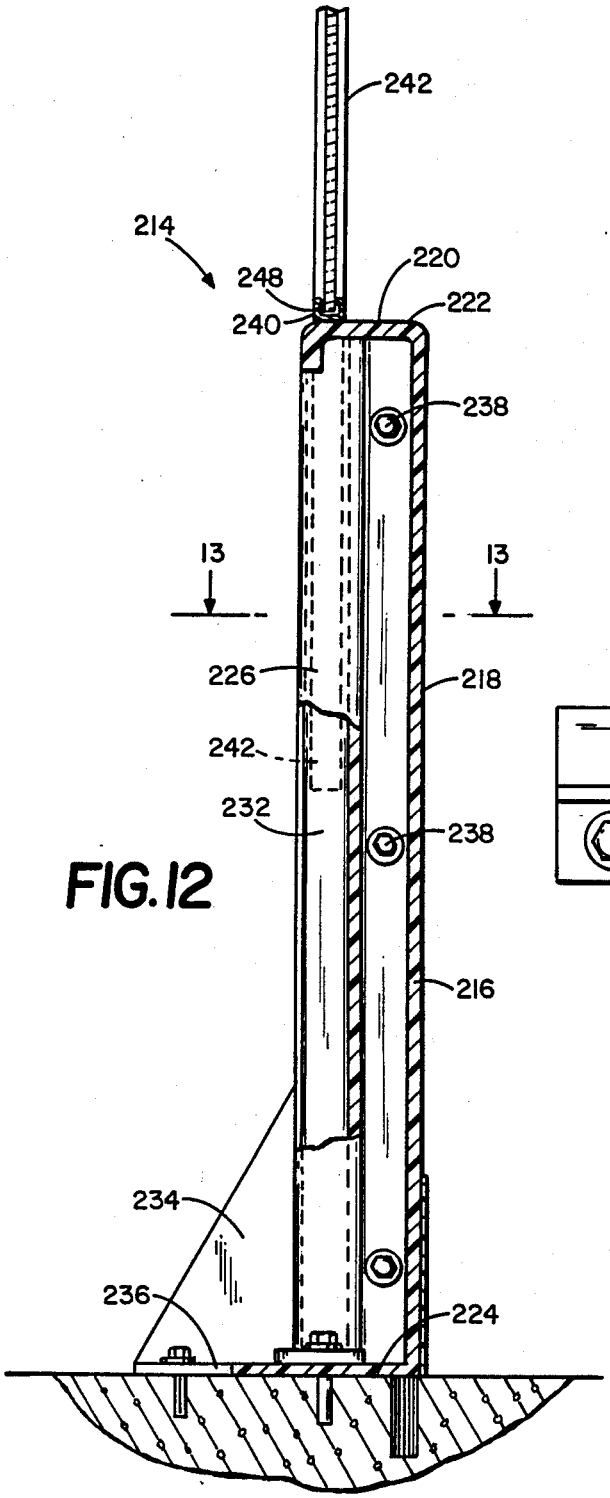
FIG 12 is a sectional view similar to that in FIG. 2 but showing a fourth embodiment dasher panel.
Figure 13:
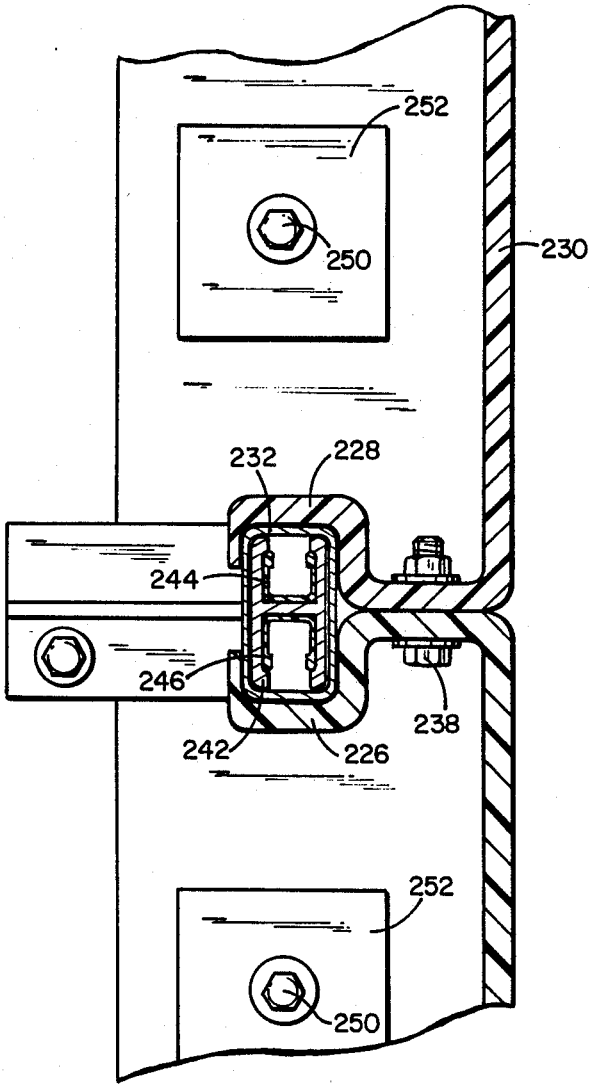
FIG. 13 is a sectional view taken along the line 13—13 in FIG. 12.

FIGS. 12 and 13 show a fourth embodiment dasher section 214, including a one-piece fiberglass dasher panel 216 having a rectangular face 218 and a rim 220 normal to the face to define a top flange 222, a bottom flange 224, and upright side flanges 226 and 228, this latter side flange shown in FIG. 13 as part of a next adjacent fiberglass dasher panel 230. The fiberglass dasher panels are supported at their junctions by a series of upright $2\frac{1}{2}'' \times 1\frac{1}{2}''$ tubing sections as indicated at 232, each with an integral gusset 234 and base plate 236. Opposing side flanges 226 and 228 of the dasher board panels have opposed "U" configurations which cooperate to form an enclosure about tubing section 232 when adjacent panels are fastened together with bolts 238. A plurality of horizontal channel members are attached to top flange 222, one of which is shown at 240. A plurality of upright channel members 242 are supported within tubing sections 232. Each of the upright and horizontal channel members is lined with a plastic cushion insert, as indicated at 244 and 246 (with upright channel member 242) and at 248 (with horizontal channel member 240), for the purpose previously described. In addition to being secured to tubing sections 232, the dasher panels are secured directly by anchoring bolts 250, each running through a substantially square polyethylene anchoring plate 252 and the bottom flange of the associated fiberglass panel. The bolts and square anchoring plates are regularly spaced along the bottom of each fiberglass dasher panel.

Unitary construction of the panels with fiberglass minimizes the number of separate parts, and provides for an exceptionally strong, lightweight panel. Moreover, the fiberglass panels have a low temperature coefficient of expansion and are less subject to fading of colors or structural deterioration when exposed to ultraviolet rays.

Figure 14:
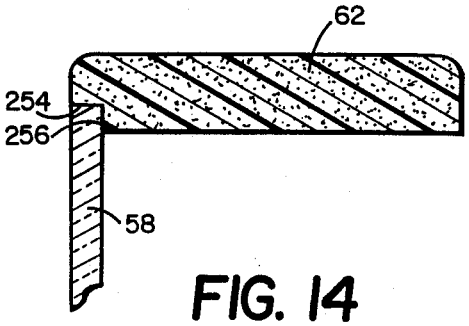
FIG. 14 is a sectional view taken along the line 14—14 in FIG. 1.
Figure 8:
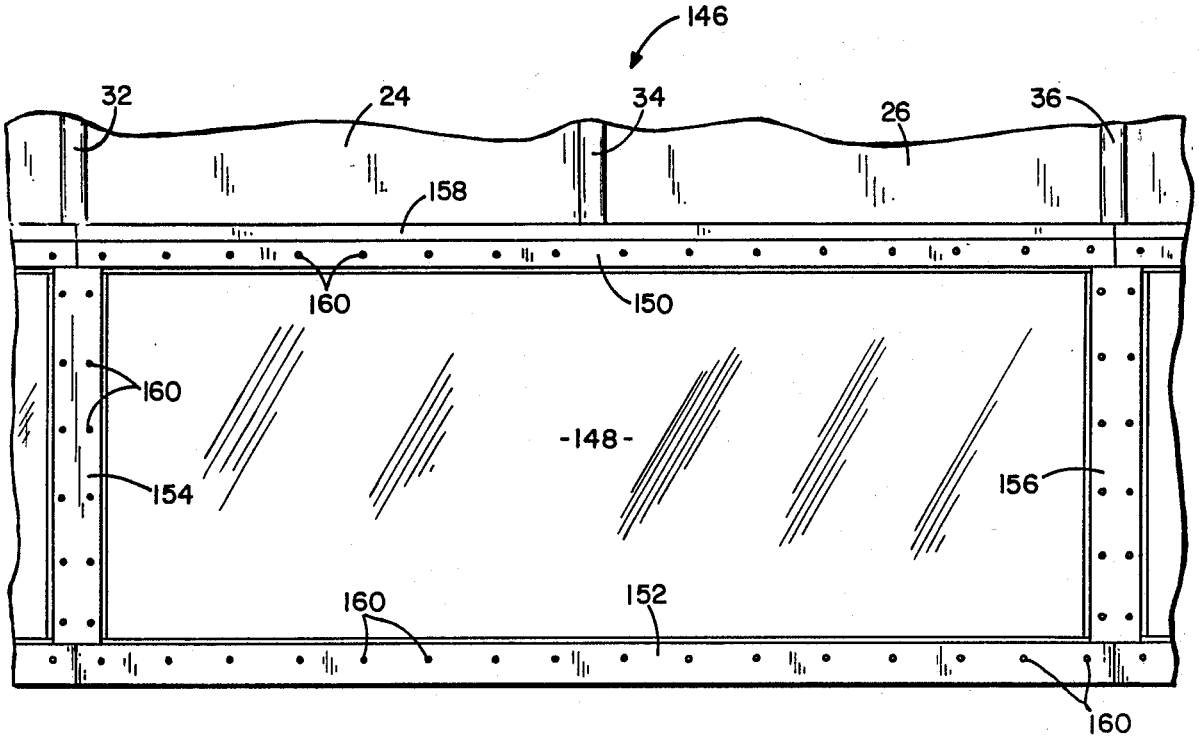
FIG. 8 is a partial elevational view of a dasher panel section of a third embodiment dasher panel.

FIG. 14 shows inclined rail 62 in greater detail. The inclined rail preferably is constructed of polyethylene or similar plastic. A notch is formed along inclined rail 62 to provide flat surfaces 254 and 256, perpendicular to one another and contiguous with glance panel 58. A pair of brackets 258 and 260, shown in FIG. 1, secure inclined rail 62 with respect to upright channel member 36 and horizontal channel 60, respectively. The inclined edge of glance panel 58 is flush against glance panel 58 and thus supported, upon impact, against bending or cracking.

The disclosed embodiments thus provide a construction which facilitates rapid, reduced cost installation of dasher systems around athletic playing surfaces. Moreover, since substantially the same mounting .system can be provided for systems directed to soccer and ice hockey, the change-over between these sports is not only possible at the same facility, but convenient as well. The channel member support for the acrylic shielding provides easy, drop-in installation of the shielding panels, and further assists in alignment of adjacent dasher board sections.

What is claimed is:

1. A system of interconnected dasher boards for surrounding an athletic playing surface, each board comprising:

a lower front facing panel;

a plurality of spaced apart horizontal frame members attached with respect to said facing panel and running parallel thereto;

a plurality of first upright spaced apart edge supporting frame assmblies positioned at each junction of adjacent dasher boards, each anchored to the ground so as to be fixed with respect to said playing surface;

a plurality of second upright spaced apart frame assemblies intermediate the edges of said panels, each anchored to the ground so as to be fixed with respect to said playing surface; and a plurality of brackets integral with said second upright support assemblies and removably mounted to said horizontal frame members to secure said horizontal frame members integrally with respect to said second upright frame assemblies.

2. The system of claim 1 wherein:

each of said first and second upright frame assemblies is anchored to the ground at a point outside of the perimeter of said playing surface.

3. The system of claim 2 further including:

a reinforcing lower panel member at least approximately the same size as said facing panel and contiguous with said facing panel, said spaced apart horizontal frame members being attached to said reinforcing panel along a surface of the reinforcing panel opposite to a surface thereof contiguous with said facing panel.

4. The system of claim 2 wherein:

each of said first and second upright support assemblies includes a lower rectangular tubing section, a support pocket integral with an upper portion of said lower rectangular tubing section, and an upper tubing section with a narrower lower portion sized for nesting engagement within said pocket for integrally supporting the upper section within the lower tubing section.

5. The system of claim 4 wherein:

said pocket in each said edge supporting upright is adjacent an upper portion of the side of each said lower tubing section, and the pocket of each intermediate support assembly comprises an upper portion of its respective lower tubing section.

6. The system of claim 5 further including:

a horizontal and upwardly open U-shaped channel means mounted with respect to the top of each of said facing panels and reinforcing panels, and a plurality of upright H-shaped channel means mounted to each of said first and second upright frame assemblies, and a plurality of substantially transparent upper panels, said H-shaped channel means and U-shaped channel means cooperating to support the transparent panels.

7. The system of claim 1 wherein:

said first and second upright support frame assemblies include a lower rectangular tubular member, a pocket integral with an upper portion of the lower tubular member, with each pocket supporting a lower portion of an H-shaped channel member.

8. The system of claim 7 further including:

an elastically yielding U-shaped liner in each of said U-shaped channel means and H-shaped channel means elastically deformed when its associated channel means receives one of said transparent upper panels.

9. The system of claim 1 wherein:

each of said horizontal frame members is a steel angle member.

10. A dasher board system comprising a plurality of interconnected dasher boards for surrounding an athletic playing surface, comprising:

a plurality of rectangular dasher segments, each including a front lower facing panel with a top edge, a bottom edge and first and second side edges;

a plurality of battens including a top batten, a bottom batten and a plurality of upright battens, positioned to define an outer frame surrounding an associated one of said lower facing panels;

a plurality of first upright and spaced apart edge support frame assemblies, one at each junction of adjacent facing panels and anchored with respect to the ground, and a fastening means for removably fixing each of said upright battens to one of said first upright edge support frame assemblies; and a plurality of horizontal frame members, a means for securing said horizontal frame members with respect to said first upright frame assemblies, and a means for removably fixing said top and bottom battens to associated ones of said horizontal frame members;

wherein each of said battens includes an extension inwardly of said outer frame and disposed to form an overlapping engagement with the associated front lower facing panel along said top edge, bottom edge and side edges, whereby said battens cooperate with said first and second fastening means to removably secure said associated front lower facing panel against said horizontal frame members and said first uprights.

11. The dasher board system of claim 10 wherein:

each of said extensions includes a forwardly disposed flange, and each of said top edge, bottom edge and side edges has an outwardly extended, rearwardly disposed flange, said forwardly disposed flanges and rearwardly disposed flanges engaged for retaining said lower front facing panel in rabbited fashion.

12. The dasher board system of claim 11 wherein:

said front lower facing panels are transparent.

13. The dasher board system of claim 12 wherein:

said first upright edge support frame assemblies are anchored to the ground at a point outside of the perimeter of said athletic playing surface.

14. The dasher board system of claim 10 further including:

a plurality of second upright spaced apart intermediate frame assemblies between the side edges of said panels, and a plurality of fastening members integral with said second upright frame assemblies for removably attaching said intermediate frame assemblies and said horizontal frame members.

15. The dasher board system of claim 10 wherein:

the inside edge of each of said battens is inclined, and said top edge, bottom edge and first and second side edges are each inclined to correspond with the associated one of said inside edges of said battens, whereby said battens and said associated front lower facing panel form mitered junctions to secure said facing panel.

16. A dasher board system including a plurality of dasher boards for surrounding an athletic playing surface, comprising:

a plurality of dasher boards each having a lower section, including a flat facing portion and a supporting flange substantially perpendicular to said facing portion having a top portion, a bottom portion and two side portions;

a plurality of upright edge support frame assemblies secured with respect to the said playing surface; and means forming a U-shaped channel along each of said side portions, the channels of opposed side portions of adjacent panels cooperating to form a rectangular enclosure for receiving an associated one of said upright support assemblies to secure said dasher boards with respect to said frame assemblies a separate U-shaped channel means mounted on the exposed surface of each of said top flange portions and lined with an elastically yieldable cushion insert and open upwardly from said top flange portions, and a plurality of upright H-shaped channel members, each of said H-shaped channel members configured to slidably engage one of said upright edge support frame assemblies.

17. The dasher board system of claim 16 wherein:

each of said lower sections of said dasher boards comprises a unitary member constructed of fiberglass.

18. In an assembly including a plurality of interconnected dasher boards for surrounding an athletic playing field, including a first dasher board having a first lower panel, and a second dasher board adjacent said first dasher board, said second board including a second lower panel and a substantially transparent upper panel; an improvement comprising:

an upright support member between said first and second dasher boards; a substantially transparent right triangular panel having first and second mutually perpendicular side edges supported along said upright support member and a horizontal top edge of said first lower panel, respectively; and an inclined rail secured at opposite ends thereof to said upright support member and to said top edge and running along an inclined edge of said triangular panel to cooperate with said top edge and said upright support member to surround and support said transparent panel.

* * * * *